US010617267B2

(12) United States Patent
Cao et al.

(10) Patent No.: US 10,617,267 B2
(45) Date of Patent: Apr. 14, 2020

(54) TOILET

(71) Applicant: BOE TECHNOLOGY GROUP CO., LTD., Beijing (CN)

(72) Inventors: Lei Cao, Beijing (CN); Xiao Zhang, Beijing (CN); She Lin, Beijing (CN); Zifeng Wang, Beijing (CN); Nannan Hu, Beijing (CN); Yan Ren, Beijing (CN); Hailan Jin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 27 days.

(21) Appl. No.: 15/647,535

(22) Filed: Jul. 12, 2017

(65) Prior Publication Data

US 2018/0035852 A1 Feb. 8, 2018

(30) Foreign Application Priority Data

Aug. 2, 2016 (CN) ..... 2016 1 0627158

(51) Int. Cl.

| | |
|---|---|
| ***A47K 13/06*** | (2006.01) |
| ***A47K 13/24*** | (2006.01) |
| ***E03D 5/10*** | (2006.01) |

(52) U.S. Cl.

CPC ..... *A47K 13/06* (2013.01); *A47K 13/24* (2013.01); *E03D 5/10* (2013.01); *A47K 13/247* (2013.01)

(58) Field of Classification Search

USPC ..... 4/244.2, 238

See application file for complete search history.

(56) References Cited

U.S. PATENT DOCUMENTS 5,253,372 A * 10/1993 Boker ..... A47K 13/145 4/243.2

7,155,749 B1 * 1/2007 Gelbart ..... A47K 13/22 4/244.2

FOREIGN PATENT DOCUMENTS

| | | | |
|---|---|---|---|
| CN | 1206584 | A | 2/1999 |
| CN | 2568111 | Y | 8/2003 |
| CN | 1711048 | C | 12/2005 |
| CN | 2783927 | Y | 5/2006 |
| CN | 101953659 | A | 1/2011 |
| CN | 203383305 | U | 1/2014 |

(Continued)

OTHER PUBLICATIONS

First Office Action for Chinese Patent Application No. 201610627158.0 dated Jun. 25, 2018.

*Primary Examiner* — Lauren A Crane

(74) *Attorney, Agent, or Firm* — Calfee, Halter & Griswold LLP

(57) ABSTRACT

The present disclosure relates to the field of sanitation, and discloses a toilet. The toilet includes a toilet bowl on which a toilet seat is provided, the toilet further includes: a detecting device configured to detect position information of a user; a retractable cover provided on the toilet seat and switchable between statuses of closing a through hole of the toilet seat and opening the through hole of the toilet seat; and a controller in signal connection to the detecting device and the retractable cover, and the controller is configured to compare the position information detected by the detecting device with a preset range, wherein the retractable cover is configured to retract in the case where the position information falls within the preset range, and to extend to cover the through hole in the case where the position information exceeds the preset range.

8 Claims, 4 Drawing Sheets

(56) References Cited

FOREIGN PATENT DOCUMENTS

| | | | |
|---|---|---|---|
| JP | H08218468 | A | 8/1996 |
| KR | 100891927 | B1 | 4/2009 |
| KR | 20090120764 | A | 11/2009 |

* cited by examiner

TOILET

CROSS REFERENCE

The present application claims priority to Chinese Patent Application No. 201610627158.0, filed on Aug. 2, 2016, and the entire contents thereof are incorporated herein by reference.

TECHNICAL FIELD

The present disclosure relates to the field of sanitation, and more particularly to a toilet.

BACKGROUND

Generally, a toilet includes a toilet bowl and a water tank, the toilet bowl is adapted to accommodate solid or liquid wastes and water, and the water tank is a storage for providing water to flush the wastes away from the toilet bowl. The flushing device is installed in the water tank, and a user can operate the flushing device outside the water tank to initiate flushing.

It should be noted that, information disclosed in the above background portion is provided only for better understanding of the background of the present disclosure, and thus it may contain information that does not form the prior art known by those ordinary skilled in the art.

SUMMARY

The present disclosure provides a toilet.

For the above purposes, the present disclosure provides the implementations below.

The present disclosure provides a toilet including a toilet bowl on which a toilet seat is provided, and the toilet further including:

a detecting device configured to detect position information of a user;

a retractable cover provided on the toilet seat and switchable between statuses of closing a through hole of the toilet seat and opening the through hole of the toilet seat; and a controller in signal connection to the detecting device and the retractable cover, and the controller is configured to compare the position information detected by the detecting device with a preset range, wherein the retractable cover is configured to retract in the case where the position information falls within the preset range, and to extend to cover the through hole in the case where the position information exceeds the preset range.

It is to be understood that both the foregoing general description and the following detailed description are exemplary and explanatory only and are not restrictive of the present disclosure, as claimed.

This section provides a summary of various implementations or examples of the technology described in the disclosure, and is not a comprehensive disclosure of the full scope or all features of the disclosed technology.

BRIEF DESCRIPTION OF THE DRAWINGS

The accompanying drawings herein are provided for a further understanding of the present disclosure and constitute a part of the specification. Exemplary embodiments of the present disclosure and descriptions thereof are provided for illustration of the present disclosure, which are not to be construed as unnecessary limiting the present disclosure. In the drawings.

In the drawings.

1. Toilet Seat; 11. Through Hole; 2. Detecting Device; 3. Retractable Cover; 31. Foldable Curtain; 32. First Scroll; 33. Roller Curtain; 34. First Elastic Puller; 4. Retractable Auxiliary Toilet Seat; 41. Hollow Part; 42. Second Scroll; 43. Flexible Pad; and 5. Controller.

DETAILED DESCRIPTION

Hereinafter, implementations according to embodiments of the present disclosure will be described clearly and completely with reference to the accompanying drawings of the embodiments of the present disclosure. Apparently, the described embodiments are merely part of the embodiments of the present disclosure, rather than all the embodiments of the present disclosure.

Figure 1:
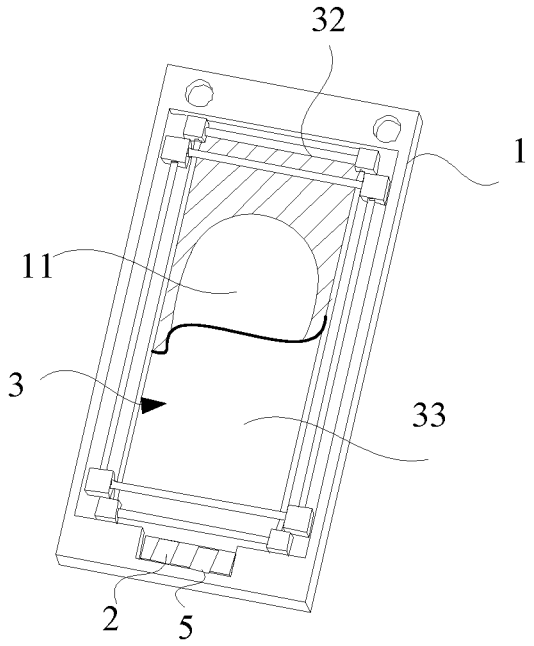
FIG. 1 is a schematic view of a first form of a partial structure of the toilet according to an embodiment of the present disclosure.
Figure 2:
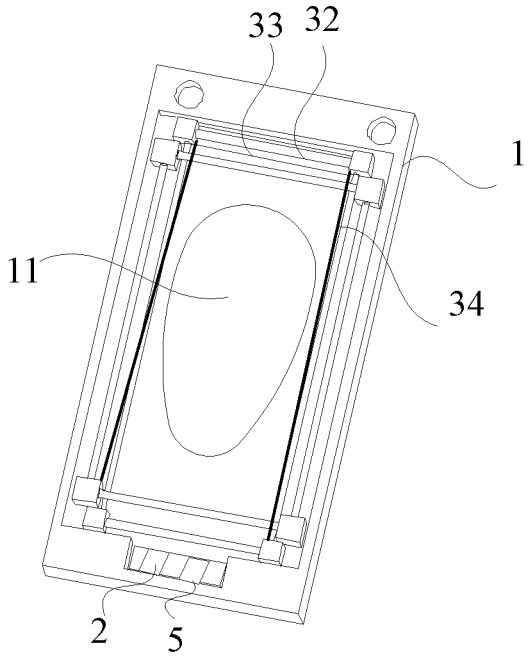
FIG. 2 is a schematic view of a second form of a partial structure of the toilet according to an embodiment of the present disclosure.

As illustrated in FIG. 1 and FIG. 2, wherein FIG. 1 is a schematic view of a first form of a partial structure of the toilet according to an embodiment of the present disclosure, and FIG. 2 is a schematic view of a second form of a partial structure of the toilet according to an embodiment of the present disclosure. The toilet according to the present disclosure includes a toilet bowl, and a toilet seat 1 is provided on the toilet bowl. The toilet further includes the components that follow.

A detecting device 2 is configured to detect position information of a user.

A retractable cover 3 is provided on the toilet seat 1 and switchable between statuses of closing a through hole 11 of the toilet seat 1 and opening the through hole 11 of the toilet seat 1.

A controller 5 is in signal connection to the detecting device 2 and the retractable cover 3, and the controller 5 is configured to compare the position information detected by the detecting device 2 with a preset range.

When the position information falls within the preset range, the retractable cover 3 is controlled to retract, and when the position information exceeds the preset range, the retractable cover 3 is controlled to extend to cover the through hole 11.

In the toilet according to the present disclosure, by providing the detecting device 2, it is possible to detect position information of the user in real time; by providing the retractable cover 3, it is possible to control the through hole 11 of the toilet seat 1 to be opened or closed; the controller 5 may compare the position information detected by the detecting device 2 with the preset range, and controls the retractable cover 3 to retract when the position information falls within the preset range, such that the through hole 11 of the toilet seat is opened and controls the retractable cover 3 to extend to cover the through hole 11 when the position information exceeds the preset range. Accordingly, it is possible to prevent the user from forgetting to close the retractable cover 3 after using the toilet, and when the toilet is not in use, the retractable cover 3 extends to cover the through hole 11 of the toilet seat 1, thereby preventing the spread of bacteria in the toilet.

Thus, according to the toilet provided by the present disclosure, it is possible to reduce the occurrence of bacterial contamination.

The above preset range may be set by those skilled in the art according to actual needs, and optionally, a control panel may be provided on the toilet so that the user can change and set the preset range.

The above detecting device may be an IR (infrared) sensor, and the IR sensor itself has a detecting range. When the user is positioned within the detecting range (i.e., when the IR sensor senses approach of an object), the controller controls the retractable cover to retract for the convenience of the user's use, and when the user is positioned outside the detecting range (i.e., when the IR sensor can sense no object), the controller controls the retractable cover to extend to cover the through hole.

In particular, the detecting device may be a distance sensor. A distance between the user and the toilet is detected using the detecting device, and the extension and retraction of the retractable cover is controlled according to the distance sensor. Obviously, how does the detecting device detect the position information of the user is not limited to the above examples, and it is possible to use detecting schemes in the art, which will not be discussed herein.

The above controller 5 is in signal connection to a flushing device in the water tank of the toilet. The controller 5 is further configured to control the flushing device to flush after the retractable cover 3 extends to cover the through hole 11. This is easy for the user to use, so as to prevent the user from forgetting to flush, thereby further reducing the occurrence of bacterial contamination.

The above retractable cover 3 may have various specific structures.

Figure 3:
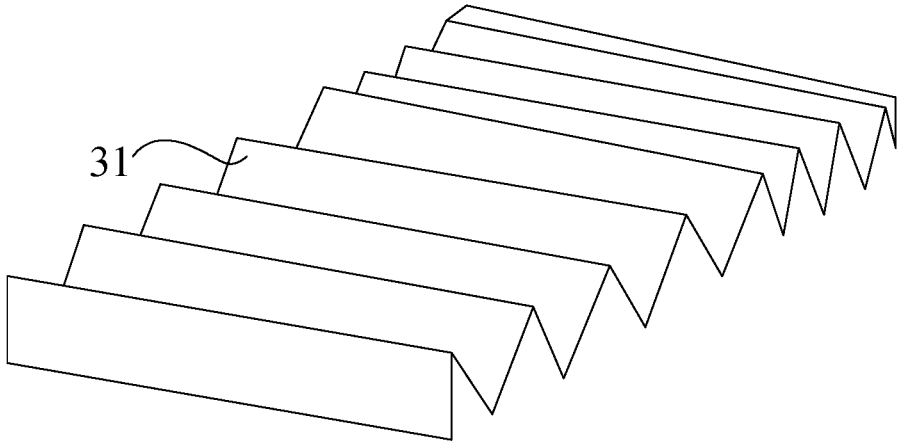
FIG. 3 is a structural schematic view of the retractable cover in the toilet according to an embodiment of the present disclosure.

In an optional implementation, as illustrated in FIG. 3 which is a structural schematic view of the retractable cover 3 in the toilet according to an embodiment of the present disclosure, the retractable cover 3 includes a foldable curtain 31 and a first driving device for driving the foldable curtain 31 to extend or retract.

The above first driving device may have various specific structures. Optionally, the first driving device includes a driving motor and a screw connected to the driving motor. A free end of the screw is connected to the foldable curtain 31, and the rotation of the driving motor drives the screw to move, such that the foldable curtain 31 may extend or retract. Optionally, the first driving device may also be a telescoping cylinder. A free end of the telescoping cylinder is connected to the foldable curtain 31, and the extension and retraction of the telescoping cylinder controls the foldable curtain to extend or retract.

In another optional implementation, the retractable cover 3 includes: a first scroll 32 mounted on a side of the toilet seat 1, a roller curtain 32 wound on the first scroll 32; and a second driving device driving the roller curtain 33 to wind (i.e., retract) or unwind (i.e., extend). The through hole 11 of the toilet seat 1 may be covered by unwinding the roller curtain 33, and the through hole 11 of the toilet seat 1 may be opened by the first scroll 32 winding the roller curtain 33.

The above second driving device may have various specific structures, and according to an optional implementation of the present disclosure, the second driving device includes the below components.

A first driving motor drives the first scroll 32 to rotate.

Two first elastic pullers 34, each of the first elastic pullers 34 has a first end connected to a free end of the roller curtain 33 and a second end connected to a side of the toilet seat 1 opposite to the side at which the first scroll 32 is provided. By providing the two first elastic pullers 34, it is possible to prevent the free end of the roller curtain 33 from dropping when the roller curtain 33 is unwound. When the roller curtain 33 is unwound, the two first elastic pullers 34 are in their original lengths or are extended, and when the roller curtain 33 is wound, the two first elastic pullers 34 are extended. Optionally, the two first elastic pullers 34 have the same original length and the same extension length.

Optionally, each of the first elastic pullers 34 may be a spring or an elastic string.

Figure 4:
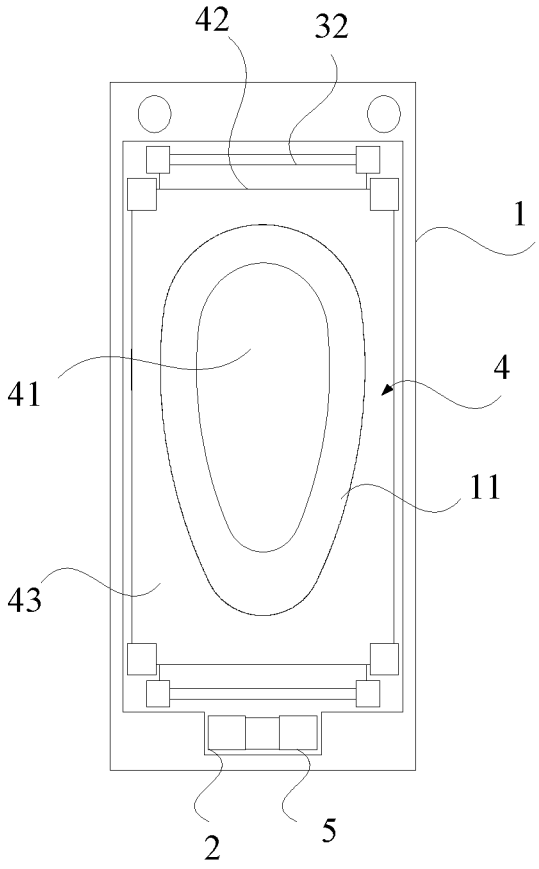
FIG. 4 is a schematic view of a third form of a partial structure of the toilet according to an embodiment of the present disclosure.

In order to broaden the use of the toilet, as illustrated in FIG. 4 which is a schematic view of a third form of a partial structure of the toilet according to an embodiment of the present disclosure. The toilet further includes: a retractable auxiliary toilet seat 4 provided on the toilet seat 1. The retractable auxiliary toilet seat 4 includes a hollow part 41 corresponding to the position of the through hole 11 of the toilet seat 1, and the hollow part 41 has an area smaller than that of the through hole 11. The retractable auxiliary toilet seat 4 is provided to facilitate the use of children, thereby broadening the use of the toilet.

Optionally, the hollow part 41 has a shape the same as that of the through hole 11.

Also, the detecting device 2 is further configured to detect height information of the user.

The controller 5 is in signal connection to the retractable auxiliary toilet seat, and the controller 5 is further configured to compare the height information with a first preset value and a second preset value.

When the height information is greater than the first preset value and smaller than the second preset value, the retractable auxiliary toilet seat 4 is controlled to extend. The through hole 11 may be narrowed by the hollow part 41 of the extended retractable auxiliary toilet seat 4, thereby facilitating the use of children.

Also, for convenience, the above controller is further configured to control the retractable auxiliary toilet seat 4 to retract when the height information is greater than the second preset value. In this embodiment, the second preset value is greater than the first preset value. The height information of the user is detected by the detecting device.

The above first and second preset values may be set by those skilled in the art according to actual needs, and optionally, a control panel may be provided on the toilet so that the user can change and set the first and second preset values.

The above detecting device 2 may have various specific structures, and in an optional implementation of the present disclosure, the detecting device 2 may have the following structure.

Two IR sensors are provided on the toilet seat 1, and detection points of the two IR sensors are located at different heights. Accordingly, the two IR sensors may detect two points at different heights. When both of the IR sensors detect an object, the retractable auxiliary toilet seat 4 does not extend or changes from the extended state into the retracted state. When the lower one of the two IR sensors detects an object while the higher one of the two IR sensors detects no object, the retractable auxiliary toilet seat 4 is controlled to extend. Also, each of the IR sensors itself has a detecting range. When the user is positioned within the detecting range (i.e., when the IR sensor senses approach of an object), the controller controls the retractable cover to retract for the convenience of the user's use, and when the user is positioned outside the detecting range (i.e., when the IR sensor can sense no object), the controller controls the retractable cover to extend to cover the through hole.

A different between the heights of the detecting points of the two IR sensors may be set by those skilled in the art according to actual needs.

The above two IR sensors may be provided on the front of the toilet bowl, or on the water tank, or on other positions of the toilet, which will not be described in detail herein.

The above retractable auxiliary toilet seat 4 may have various specific structures, and in an optional implementation of the present disclosure, the retractable auxiliary toilet seat 4 may have the following structure.

A second scroll 42 is mounted at a side of the toilet seat 1.

A flexible pad 43 is wound on the second scroll 42.

A third driving device is configured to drive the flexible pad 43 to wind (i.e., retract) or unwind (i.e., extend).

The above third driving device may have various specific structures, and in an optional implementation of the present disclosure, the third driving device may have the following structure.

A second driving motor is configured to drive the second scroll 42 to rotate.

Two second elastic pullers each of which has a first end connected to a free end of the flexible pad 43 and a second end connected to a side of the toilet seat 1 opposite to the side at which the second scroll 42 is provided.

Optionally, each of the second elastic pullers may be a spring or an elastic string.

In the toilet according to the present disclosure, by providing the detecting device, it is possible to detect position information of the user in real time; by providing the retractable cover, it is possible to control the through hole of the toilet seat to be opened or closed; the controller may compare the position information detected by the detecting device with the preset range, and control the retractable cover to retract when the position information falls within the preset range such that such that the through hole of the toilet seat is opened and control the retractable cover to extend to cover the through hole when the position information exceeds the preset range. Accordingly, it is possible to prevent the user from forgetting to close the retractable cover after using the toilet, and when the toilet is not in use, the retractable cover extends to cover the through hole of the toilet seat, thereby preventing the spread of bacteria in the toilet.

Thus, according to the toilet provided by the present disclosure, it is possible to reduce the occurrence of bacterial contamination.

Apparently, various amendments and modifications to the present disclosure are possible to those skilled in the art, without departing from the sprite and scope of the present disclosure. As such, the present disclosure intends to involve these changes and modifications to the present disclosure as long as they belong to the claims and its equivalent technical scope of the present disclosure.

What is claimed is:

1. A toilet comprising a toilet bowl on which a toilet seat is provided, and the toilet further comprising:

a detecting device configured to detect position information of a user;

a retractable cover provided on the toilet seat and switchable between statuses of closing a through hole of the toilet seat and opening the through hole of the toilet seat; and a controller in signal connection to the detecting device and the retractable cover, and the controller is configured to compare the position information detected by the detecting device with a preset range, wherein the retractable cover is configured to retract in the case where the position information falls within the preset range, and to extend to cover the through hole in the case where the position information exceeds the preset range, wherein the retractable cover is disposed on a side of the toilet seat and the through hole of the toilet seat is configured to expose the toilet bowl when the toilet seat is in position, wherein the controller is further in signal connection to a flushing device in the water tank of the toilet, and the controller is further configured to control the flushing device to flush after the retractable cover extends to cover the through hole, wherein the retractable cover comprises a foldable curtain and a first driving device for driving the foldable curtain to extend or retract, wherein the toilet further comprising:

a retractable auxiliary toilet seat provided on the toilet seat, the retractable auxiliary toilet seat comprising a hollow part corresponding to the position of the through hole of the toilet seat, and the hollow part having an area smaller than that of the through hole, the hollow part has a shape the same as a shape of the through hole, the detecting device is further configured to detect height information of the user, the controller is in signal connection to the retractable auxiliary toilet seat, and the controller is further configured to compare the height information with a first preset value and a second preset value, and in the case where the height information is greater than the first preset value and smaller than the second preset value, the retractable auxiliary toilet seat is controlled to extend, and wherein the controller is further configured to control the retractable auxiliary toilet seat to retract in the case where the height information is greater than the second preset value, wherein the second preset value is greater than the first preset value.

2. The toilet according to claim 1, wherein the retractable cover comprises:

a first scroll mounted on a side of the toilet seat;

a roller curtain wound on the first scroll; and a second driving device driving the roller curtain to wind or unwind.

3. The toilet according to claim 2, wherein the second driving device comprises:

a first driving motor driving the first scroll to rotate; and two first elastic pullers, each of the first elastic pullers having a first end connected to a free end of the roller curtain and a second end connected to a side of the toilet seat opposite to the side at which the first scroll is provided.

4. The toilet according to claim 3, wherein each of the first elastic pullers is a spring.

5. The toilet according to claim 1, wherein the detecting device comprises two IR sensors provided on the toilet seat, and detection points of the two IR sensors are located at different heights.

6. The toilet according to claim 1, wherein the retractable auxiliary toilet seat comprises:

a second scroll mounted at a side of the toilet seat;

a flexible pad wound on the second scroll; and a third driving device configured to drive the flexible pad to wind or unwind.

7. The toilet according to claim 6, wherein the third driving device comprises:

a second driving motor configured to drive the second scroll to rotate; and two second elastic pullers, each comprising a first end connected to a free end of the flexible pad and a second end connected to a side of the toilet seat opposite to the side at which the second scroll is provided.

8. The toilet according to claim 7, wherein each of the second elastic pullers is a spring.

* * * * *